United States Patent [19]

Liu et al.

[11] Patent Number: 4,798,678

[45] Date of Patent: Jan. 17, 1989

[54] HYDROCARBON CONTAINING ANTI-OXIDANT SYSTEM

[75] Inventors: Christopher S. Liu, Poughkeepsie; Larry D. Grina, Wappingers Falls; Maria M. Kapuscinski, Carmel, all of N.Y.

[73] Assignee: Texaco Inc., White Plains, N.Y.

[21] Appl. No.: 43,014

[22] Filed: Apr. 27, 1987

[51] Int. Cl.[4] ..... C10M 141/06

[52] U.S. Cl. ..... 252/50

[58] Field of Search ..... 252/50

[56] References Cited

U.S. PATENT DOCUMENTS 2,742,349 4/1956 McCoy ..... 252/50

OTHER PUBLICATIONS

Encyclopedia of Chemical Technology, vol. 3, Kirk-Othmer, pp. 128-132.

*Primary Examiner*—William R. Dixon, Jr.
*Assistant Examiner*—Jerry D. Johnson
*Attorney, Agent, or Firm*—Robert A. Kulason; James J. O'Loughlin; Carl G. Seutter

[57] ABSTRACT

An oil containing a viscosity index improver of improved oxidative stability contains, as an anti-oxidant system, 2,6-di-t-butylphenol and N-aminoethylpiperazine.

20 Claims, No Drawings

HYDROCARBON CONTAINING ANTI-OXIDANT SYSTEM

FIELD OF THE INVENTION

This invention relates to hydrocarbon liquids containing an anti-oxidant system. More particularly it relates to an oil containing a viscosity index improver and an anti-oxidant system.

BACKGROUND OF THE INVENTION

As is well known to those skilled in the art, middle distillate hydrocarbons and lubricating oils are commonly employed under conditions wherein their oxidation stability is a significant factor. In the case of lubricating oils for example the properties of the oil may be significantly changed when the oil is subjected to oxidation. Typically the oil may become darker, thicker, and it may decompose to a mixture containing a larger concentration of solids. When the lubricating oil contains additives such as viscosity index improvers for example, it is found that many of these additives are particularly susceptible to oxidation; and their effectivity is diminished as they are oxidized during operation.

It is an object of this invention to provide an anti-oxidant system which is particularly characterized by its ability to function in hydrocarbon oils. Other objects will be apparent to those skilled in the art.

STATEMENT OF THE INVENTION

In accordance with certain of its aspects, this invention is directed to an anti-oxidant composition comprising a hindered phenol; and a piperazine.

DESCRIPTION OF THE INVENTION

The first component which may be present in the composition of this invention is a hindered phenol. A hindered phenol is an aromatic compound including an aryl ring: anthracene, naphthalene, or preferably a benzene ring-bearing at least one phenol —OH group thereon. It also includes at least one and preferably two hindering R groups adjacent to the phenol hydroxy group. These hindering R groups may be alkyl, alkaryl, aralkyl, cycloalkyl, aryl, etc. groups.

In the above compound, R may typically be a hydrocarbon group selected from the group consisting of alkyl, aralkyl, cycloalkyl, aryl, and alkaryl including such radicals when inertly substituted. When R is alkyl, it may typically be methyl, ethyl, n-propyl, iso-propyl, n-butyl, i-butyl, sec-butyl, amyl, octyl, decyl, octadecyl, etc. When R is aralkyl, it may typically be benzyl, beta-phenylethyl, etc. When R is cycloalkyl, it may typically be cyclohexyl, cycloheptyl, cyclooctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. R may be inertly substituted i.e. it may bear a non-reactive substituent such as alkyl, aryl, cycloalkyl, ether, etc. Typical inertly substituted R groups may include 2-ethoxyethyl, carboethoxymethyl, 4-methyl cyclohexyl, etc. The preferred R groups may be lower alkyl, i.e. $C_1$–$C_8$ alkyl, groups including eg methyl, ethyl, n-propyl, i-propyl, butyls, amyls, hexyls, octyls, decyls, etc.

The typical hindered phenol may have the formula:

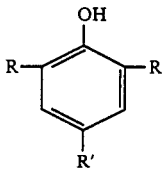

Commonly R is a branched chain alkyl group containing about 1–10 carbon atoms. R may for example be isopropyl, t-butyl, sec-butyl, isobutyl, sec-amyl, t-amyl, isoamyl, and corresponding branched hexyl, heptyl, octyl, decyl, etc. Both R groups are commonly the same. Preferred R groups may be branched chain alkyl groups containing 1–8, say 3–5 carbon atoms. Most preferred is t-butyl.

R' may be hydrogen or selected from the same group as that from which R is selected. It may be branched or straight chain. Preferably R' may be a $C_1$–$C_{14}$ alkyl radical, such as t-butyl.

Commonly the hindering groups may be lower ($C_1$–$C_{10}$) alkyl groups and most commonly they will be groups which occupy a substantial volume of space. Typical hindering groups may be isopropyl, isobutyl, t-butyl, iso-amyl, t-amyl, etc. Hindered phenols which are most readily available commercially include t-butyl groups.

Typical hindered phenols may be those set forth in the following table, the first listed being most preferred:

TABLE

| |
|---|
| 2,6-di-t-butyl phenol |
| 2,6-di-t-butyl-4-methyl phenol |
| 2,6-di-t-amyl-p-cresol |
| 2,6-di-t-butyl-p-cresol |
| 2,6-di-isopropyl-4-ethylphenol |
| 2,6-di-t-butyl-4-nonylphenol |
| 2,4,6-tri-isopropylphenol |
| 2-t-butyl-4,6-di-isopropylphenol |
| 2,4,6-tri-t-butyl phenol |
| 2,6-di-isoamyl-4-ethylphenol |
| 2,6-di-t-amyl-4-n-amylphenol |
| 2,6-di-isobutyl-p-cresol |
| 2,6-di-sec-butyl-4-n-propylphenol |
| 2,6-di-t-amylphenol |
| 2,6-di-isobutylphenol |
| 2,6-di-t-butyl-4-hydroxymethylphenol |

Preferred hindered phenols may include 2,6-di-t-butylphenol; 2,6-di-t-butyl cresol; and 2,4,6-tri-isopropylphenol; 2,6,di-t-butyl-4-methylphenol; 2,4,6-tri-t-butylphenol; and 2,6-di-t-butyl-4-hydroxymethylphenol.

The second component which may be present in the composition of this invention may be a piperazine:

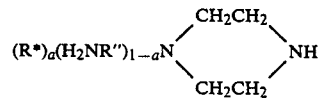

The preferred composition may be an N-aminohydrocarbylpiperazine.

R* may be hydrogen or selected from the same group as R. a may be 0 or 1.

In the above formula, R'' may be a hydrocarbon group selected from the group consisting of alkylene, aralkylene, cycloalkylene, arylene, and alkarylene, including such radicals when inertly substituted. When R″ is alkylene, it may typically be methylene, ethylene, n-propylene, iso-propylene, n-butylene, i-butylene, sec-butylene, amylene, octylene, decylene, octadecylene, etc. When R″ is aralkylene, it may typically be benzylene, beta-phenylethylene, etc. When R″ is cycloalkylene, it may typically be cyclohexylene, cycloheptylene, cyclooctylene, 2-methylcycloheptylene, 3-butylcyclohexylene, 3-methylcyclohexylene, etc. When R″ is arylene, it may typically be phenylene, naphthylene, etc. When R″ is alkarylene, it may typically be tolylene, xylylene, etc. R″ may be inertly substituted i.e. it may bear a non-reactive substituent such as alkyl, aryl, cycloalkyl, ether, etc. Typically inertly substituted R″ groups may include 3-chloropropylene, 2-ethoxyethylene, carboethoxymethylene, 4-methyl cyclohexylene, etc. The preferred R″ groups may be lower alkylene, i.e. $C_1$–$C_{10}$ alkylene, groups including eg methylene, ethylene, n-propylene, i-propylene, butylene, amylene, hexylene, octylene, decylene, etc. R″ may preferably be ethylene —$CH_2CH_2$—.

Typical second components may include those set forth in the Table:

TABLE

| |
|---|
| N—aminoethylpiperazine |
| N—methylpiperazine |
| bis-N—aminoethylpiperazine |
| N—hydroxyethylpiperazine |
| piperazine |
| bis-N—methylpiperazine |

The preferred second component may be the first listed in the above table.

The anti-oxidant compositions of this invention may contain 0.8–1.2 moles, preferably 0.9–1.1 moles, say 1 mole of hindered phenol first component per mole of N-aminohydrocarbyl piperazine second component. In the preferred embodiment, the composition may contain 1 mole of 2,6-di-t-butylphenol per mole of N-aminoethylpiperazine. This may typically correspond to 0.5–5 parts, say 2.7 parts of 2,6-di-t-butylphenol first component and 1–4 parts, say 1.7 parts of piperazine second component per 100 parts of oil—corresponding to a total of 1.5–9, say 4.4 parts per 100 parts of oil which typically containing viscosity index improver.

The hydrocarbon oils in which these anti-oxidant compositions may find particular use may include middle distillate oils or lubricating oils. Middle distillate hydrocarbon oils are particularly characterized by an ibp of 350° F.–400° F., say 360° F.; a 50% bp of 450° F.–550° F., say 500° F.; an ep of 600° F.–700° F., say 630° F.; and an API Gravity of 33–40, preferably 35–38, say 36. These hydrocarbons may commonly be identified as jet fuel avjet fuel, kerosene, fuel oil, gas oil, etc.

The middle distillate or lubricating oils may contain effective anti-oxidant amounts (per 100 parts of oil) of 0.5–5 preferably 1–3, say 2.7 parts of phenol first component and 1–4, preferably 1–2 say 1.7 parts—per 100 parts of oil which typically contains viscosity index improver.

Lubricating oils in which the anti-oxidant systems of this invention may find use include automotive, aircraft, marine, railway, etc.; compression ignition or spark ignition; winter or summer; oils. Typically the lubricating oils may be characterized by an ibp of 570° F.–b 660° F., say 610° F.; a 50% bp of 660° F.–930° F., say 790° F., say 790° F.; an ep of 750° F.–1020° F., say 880° F.; and API gravity of 25–31, preferably 28–30, say 29.

It is a feature of this invention that the anti-oxidant system may permit attainment of desirable results in lubricating oil systems which contain viscosity index improvers (VII). Typical the viscosity index improvers which may be present in formulations of this invention include olefin copolymers (such as ethylene-propylene copolymers), acrylates (including polymers and copolymers of methyl acrylate, methyl methacrylate), etc.

These VII may be present in the lubricating oil compositions in effective viscosity index improving amount of 6–14 w%, preferably 6.75–13.50 w%, say 6.75 w%.

A typical composition may be 100 parts of a SAE 10W-30 lubricating oil containing 6.75 parts of an effective viscosity index improving amount of ethylene-propylene copolymer (of $\overline{M}_n$ of 140,000 and a polydispersancy of 1.67) as a viscosity index improver and 2.7 parts of 2,6-di-t-butyl phenol and 1.7 parts of N-(2-aminoethyl piperazine).

The oxidative stability of the compositions of this invention may be determined by a Standard Test which correlates with the Sequence III D Engine Test.

In this test, samples containing 1.5 w% polymer in SNO-130 oil (together with anti-oxidant candidates) are heated and stirred while air is blown therethrough. Aliquots are removed periodically for Differential Infrared Absorption (DIR) studies. The oxidation stability of the various additives may be determined by intensity of the carbonyl vibration band at 1710/cm relative to those determined by use of VII of known oxidation stability. As the oxidation increases, carbonyl absorption increases.

It is a particular feature of the systems of this invention that they provide oxidation resistance in the presence of rubber or plastic (e.g. Viton) materials (typically found in gaskets or hoses) with which eg lubricating oils come into contact as they are used in automotive and other engines. It is found that the ability of an anti-oxidant system to prevent deterioration of rubber is a good index of its overall anti-oxidant ability.

It is found that use of the systems of this invention typically permits oxidation (as measured by DIR-absorbance/cm) to be maintained at a very low level of less than about three for up to about 160 hours. In contrast, control runs permits oxidation to occur at a high level of ca 12 after only 80 hours and up to 22 after 160 hours.

DESCRIPTION OF SPECIFIC EMBODIMENTS

Practice of this invention will be apparent to those skilled in the art from the following wherein, as elsewhere in this specification, all parts are parts by weight unless otherwise stated. Control examples are indicated by an asterisk*.

EXAMPLE I*

In this control Example, a mixture is made up containing:

(i) 98.5 g of standard base oil; and (ii) 1.5 g of substrate EPR viscosity index improver containing 55–60 mole % derived from ethylene and 40–45 mole % derived from propylene—of molecular weight $\overline{M}_n$ of 140,000 and polydispersity of 1.6

EXAMPLE II*

In this control example, there is added to the mixture of Example I* 2.7 g (0.013 g moles) of the Ethyl AN-701 brand of 2,6-di-t-butylphenol.

EXAMPLE III*

In this control example, there is added to the mixture of Example I*, 1.7 g (0.013 g moles) of N-(2-aminoethyl)piperazine.

EXAMPLE IV

In this experimental example which represents the best mode presently known of carrying out the process of this invention, there is added to the mixture of Example I*:

(i) 2.7 g (0.013 g moles) of the Ethyl AN-701 brand of 2,6-di-t-butylphenol; and (ii) 1.7 g (0.013 g moles) of N-(2-aminoethyl)piperazine.

Each of these formulations was tested by the Standard Test Supra for anti-oxidancy. In each instance, the test was carried out over 145 hours; and at regular intervals, the Absorbance/cm was measured—specifically the carbonyl absorption at 1710/cm was determined as a function of time. These data are set forth in the following table:

TABLE

| | DIR Absorbance/cm Example | | | |
|---|---|---|---|---|
| Time hrs. | I* | II* | III* | IV |
| 20 | 6.8 | 1 | 8 | 0.8 |
| 40 | 10 | 2.2 | 10 | 0.5 |
| 60 | 11.8 | 6.4 | 10.8 | 0.4 |
| 80 | 12.2 | 12.8 | 11.5 | 0.3 |
| 100 | 13 | 16 | 12 | 0.7 |
| 120 | 14 | 18 | 12.8 | 1.5 |
| 140 | 15 | 20 | 13.5 | 2.2 |

From this table, it is apparent that the Absorbance of the experimental Example IV is below 1.0 for the first 100 hours and then it gradually rises only to about 2.2 at 160 hours. This is satisfactory.

Control Run I* (no additive) and III* (only the piperazine additive) rose to 6.8–8 after only about 20 hours and were at a level of about 14 and 12.8 after 120 hours. Control Run II* was low up to about 20 hours (below about 1); but at that point it abruptly rose to about 20 at 140 hours. These are unsatisfactory.

It is clear that the system of this invention permits attainment of results not attained by the control systems. Thus although N-aminoethylpiperazine is shown (Example III*) not to be an anti-oxidant, it provides a significant boost in the anti-oxidancy of the 2,6-di-t-butyl phenol in the olefin copolymer viscosity index improving systems of this invention.

EXAMPLES V*-VI-VII*-VII*

In further comparative tests, a standard base oil composition was prepared containing 1.5 w% of ethylene-propylene rubber viscosity index improver copolymer (containing 55–60 mole % derived from ethylene and 40–45 mole % derived from propylene, $\overline{M}_n$ of 140,000, and polydispersity of 1.6). This formulation was tested in control Example V*.

In experimental Example VI, there was added to this formulation (per 100 g of ethylene-propylene rubber) 0.016 g moles of the Ethyl AD-754 brand of 4-hydroxymethyl-2,6-di-t-butylphenol and 0.032 g moles of N-aminoethylpiperazine.

In control Example VII*, there was added to the standard base oil composition, containing ethylene-propylene rubber, 0.013 g moles (per 100 g of rubber) of N-aminopiperazine and no phenol.

In control Example VII*, there was added to the standard base oil composition, containing ethylene propylene rubber, 0.026 moles (per 100 g of rubber) of N-aminoethylpiperazine and no phenol.

In control Example IX*, there was added to the standard base oil composition containing ethylene-propylene rubber, 0.013 g moles (per 100 g of rubber) of 2,6-di-t-butylphenol and no piperazine.

In control Example X*, there was added to the standard base oil composition containing ethylene-propylene rubber, 0.026 g moles (per 100 g of rubber) of 2,6di-t-butylphenol and no piperazine.

Each of these formulations was subjected to the Standard Test supra for oxidative stability. The results are as tabulated.

TABLE

| | DIR Absorbance/cm Example | | | | | |
|---|---|---|---|---|---|---|
| Time | V* | VI | VII* | VIII* | IX* | X* |
| 20 | 7.0 | 1.0 | 8.0 | 18.0 | 3.0 | 1.8 |
| 40 | 9.9 | 1.0 | 9.9 | 28.4 | 7.8 | 2.6 |
| 60 | 11.2 | 1.0 | 11.0 | 29.8 | 10.9 | 8.2 |
| 80 | 12.0 | 1.6 | 11.6 | 30.8 | 12.4 | 12.8 |
| 100 | 13.0 | 2.7 | 12.0 | 31.8 | 13.6 | 16.2 |
| 120 | 14.0 | 3.5 | 12.8 | 32.6 | 15.0 | 18.4 |
| 140 | 14.8 | 3.7 | 13.4 | 33.2 | 15.8 | 20.2 |

From the Table, it will be apparent that the formulation of this invention permits attainment of outstanding results. In control Example V, the absorbance rose to 7.0 after only 20 hours and thence to 14.8 at 140 hours.

In contrast, the system of this invention of Example VI showed an absorbance of only 1.0 at 20 hours; and at 140 hours, it had only risen to 3.7.

In control Example VII* which contained only N-aminoethyl piperazine, the anti-oxidancy was undesirably high—at about the same level as attained with no additive in control Example II*. As may be seen from control Example VIII*, the addition of twice as much (0.026 moles of N-aminoethyl piperazine) unexpectedly yields an increase in the antioxidancy i.e. presence of twice as much material gave results which were about (33.2/13.6 or) 2.44 times WORSE!

From control Example IX*, we may see that addition of 0.026 g mole of 2,b-di-t-butyl phenol reduces the anti-oxidant ability by a small factor i.e. the resistance to oxidation is slightly worse (after eg 140 hours) than is that of the rubber which contains no additives (Example II*). Specifically it is (15.8/15 or) about 5 w% higher (i.e. worse) than in the system containing no additive at all.

Similarly control Example X* shows that (at 140 hours) the anti-oxidancy is about (20.2/15 or) about 35% higher (i.e. worse) than in the system containing no additive at all.

Results comparable to those obtained with Example IV may be obtained with the following systems containing per 100 g of substrate:

TABLE

| Example | First Component | Second Component |
|---|---|---|
| XI | 2,6-di-t-butyl phenol (0.026 moles) | piperazine (0.026 moles) |
| XII | 2,6-di-t-butyl phenol (0.007 moles) | N—methyl piperazine (0.007 moles) |
| XIII | 2,6-di-t-butyl-4-methyl phenol | bis-N—aminoethyl piperazine |

TABLE-continued

| Example | First Component | Second Component |
|---|---|---|
| | (0.039 moles) | (0.039 moles) |
| XIV | 2,6-di-t-amyl-p-cresol (0.05 moles) | piperazine (0.05 moles) |
| XV | 2,6-di-t-butyl-p-cresol (0.07 moles) | bis-N—methyl piperazine (0.07 moles) |

Although this invention has been illustrated by reference to specific embodiments, it will be apparent to those skilled in the art that various changes and modifications may be made which clearly fall within the scope of this invention.

We claim:

1. An anti-oxidant composition comprising
(i) a hindered phenol; and
(ii) a piperazine.

2. An anti-oxidant composition as claimed in claim 1 wherein said hindered phenol is 2,6-di-t-butylphenol.

3. An anti-oxidant composition as claimed in claim 1 wherein said hindered phenol is 2,6-di-t-butyl-4-methyl phenol.

4. An anti-oxidant composition as claimed in claim 1 wherein said hindered phenol is 2,6,di-t-butyl-4-hydroxymethyl phenol.

5. An anti-oxidant composition as claimed in claim 1 wherein said hindered phenol is 2,4,6-tri-t-butyl phenol.

6. An anti-oxidant composition as claimed in claim 1 wherein said piperazine is an N-aminohydrocarbyl piperazine.

7. An anti-oxidant composition as claimed in claim 6 wherein in said N-aminohydrocarbyl piperazine, said amino hydrocarbyl group is a lower alkyl amino hydrocarbyl group containing 1–8 carbon atoms.

8. An anti-oxidant composition as claimed in claim 6 wherein in said N-aminohydrocarbyl piperazine, said amino hydrocarbyl group is amino ethyl.

9. An anti-oxidant composition as claimed in claim 6 wherein said N-aminohydrocarbylpiperazine is N-aminoethylpiperazine.

10. An anti-oxidant composition comprising
(i) 2,6-di-t-butylphenol; and
(ii) N-aminoethylpiperazine.

11. A lubricating oil composition comprising
(i) a major portion of a lubricating oil; and
(ii) a minor effective anti-oxidant portion of, as additive a hindered phenol and a piperazine or substituted piperazine.

12. A lubricating oil composition as claimed in claim 11 wherein said hindered phenol is 2,6-di-t-butyl phenol.

13. A lubricating oil composition as claimed in claim 11 wherein said hindered phenol is 2,6-di-t-butyl-4-methyl phenol.

14. A lubricating oil composition as claimed in claim 11 wherein said hindered phenol is 2,4,6-tri-t-butyl phenol.

15. A lubricating oil composition as claimed in claim 11 wherein said piperazine is an N-aminohydrocarbyl piperazine.

16. A lubricating oil composition as claimed in claim 15 wherein said amino hydrocarbyl group is a lower alkyl amino hydrocarbyl group containing 1–8 carbon atoms.

17. A lubricating oil composition as claimed in claim 15 wherein said N-aminohydrocarbyl piperazine is N-aminoethyl piperazine.

18. A lubricating oil composition as claimed in claim 11 wherein said effective portion is 1.5–9 parts per 100 parts of oil.

19. A lubricating oil composition as claimed in claim 11 wherein said effective portion is 3–5 parts per 100 parts of oil.

20. A lubricating oil composition as claimed in claim 11 wherein said additive contains 0.8–12 moles of hindered phenol per mole of piperazine.

* * * * *